United States Patent [19]

Yoshiba

[11] 4,300,331

[45] Nov. 17, 1981

[54] APPARATUS FOR AUTOMATICALLY PACKING RECORD DISCS

[75] Inventor: Shigeru Yoshiba, Sagamihara, Japan

[73] Assignee: Victor Company of Japan, Ltd., Yokohama, Japan

[21] Appl. No.: 99,192

[22] Filed: Nov. 29, 1979

[51] Int. Cl.[3] ..... B65B 43/26

[52] U.S. Cl. ..... 53/573; 53/254; 53/386

[58] Field of Search ..... 53/573, 572, 570, 254, 53/473, 261, 386, 173

[56] References Cited

U.S. PATENT DOCUMENTS

| | | | |
|---|---|---|---|
| 3,359,704 | 12/1967 | Phillipson et al. | 53/254 X |
| 3,490,195 | 1/1970 | Abramson | 53/572 X |
| 3,579,957 | 5/1971 | Mills, Jr. et al. | 53/573 |
| 4,149,356 | 4/1979 | Palmer | 53/573 X |

FOREIGN PATENT DOCUMENTS 1185635 3/1970 United Kingdom .

*Primary Examiner*—James F. Coan
*Attorney, Agent, or Firm*—Haseltine and Lake

[57] ABSTRACT

An apparatus for automatically packing record discs comprises a record disc table adapted to receive thereon a record disc to be packed, an inner bag stock section disposed opposite the table and stocking therein a number of inner bags in stacked arrangement, a mechanism for holding the inner bag with its unsealed edge open, which mechanism comprises a pair of arm members adapted to enter at the uppermost inner bag in the inner bag stock section through the unsealed edge thereof and to support the inner bag at the opposite ends of the unsealed edge thereof, and a mechanism for moving the holding mechanism together with the inner bag toward the table. The moving mechanism draws the inner bag over the record disc on the table and in this way the record disc is in effect inserted into the inner bag to obtain a packed record disc while the record disc remains stationary on the table. The resulting package is thereafter inserted into an empty jacket.

6 Claims, 26 Drawing Figures

20
22
22a
22b
22c
61
84
95
100a(21)
94
90
98
97
96
93
103
100
101
102
161
91
160
99
107
71
70
92
27
X1
X2
168
170
171
150
151
163
(164)
180
126
135
176
131
108
153
154
155
109
132
134
181
182
Y1
Y2
25
25a
26
162
128
174
173
175
177
169

APPARATUS FOR AUTOMATICALLY PACKING RECORD DISCS

BACKGROUND OF THE INVENTION

This invention relates generally to an apparatus for automatically packing record discs and more particularly to an automatic record disc packing apparatus capable of carrying such packing operations as insertion of a bare record disc into an inner bag and insertion of the inner bag containing the record disc therein into a jacket while precluding any danger of flawing the record disc.

In general, a record disc is deprived of its value as merchandise even by a slight flaw on the surface thereof and therefore extreme precaution is required in handling finished record discs. Heretofore, operations for packing finished bare record discs into inner bags and further into jackets have been carried out manually. As this manual work requires careful attention on the part of the workers, the process of packing the discs not only requires a large number of workers and much time, but also involves the possibility of flawing the record discs even though extreme care is taken in the operation.

On one hand, there has been developed an apparatus for packing record discs into inner bags, in which the inner bag is held stationary and the bare record disc is moved into the bag. In such arrangement, a difficulty arises in that the record surface tends to be damaged when the bare record disc is in transport.

SUMMARY OF THE INVENTION

It is a general object of the present invention to provide a novel and useful automatic record disc packing apparatus in which the above described difficulty is overcome.

A specific object of the present invention is to provide an automatic record disc packing apparatus in which the bare record discs are held stationary and empty inner bags are opened at their unsealed sides and are drawn over the record discs, whereby the record discs are in effect placed into the inner bags. According to this invention, the operation of packing the bare record discs into the inner bags is automated without creating any danger of damaging the surfaces of the record discs.

Another object of the present invention is to provide an automatic record disc packing apparatus which is arranged so that provisionally packed record discs, namely record discs which have been accomodated within inner bags, are automatically inserted into the empty jackets.

Further objects and features of this invention will be apparent from the following detailed description with respect to preferred embodiments of the present invention when read in conjunction with the accompanying drawings.

DETAILED DESCRIPTION OF THE INVENTION

Figure 1:
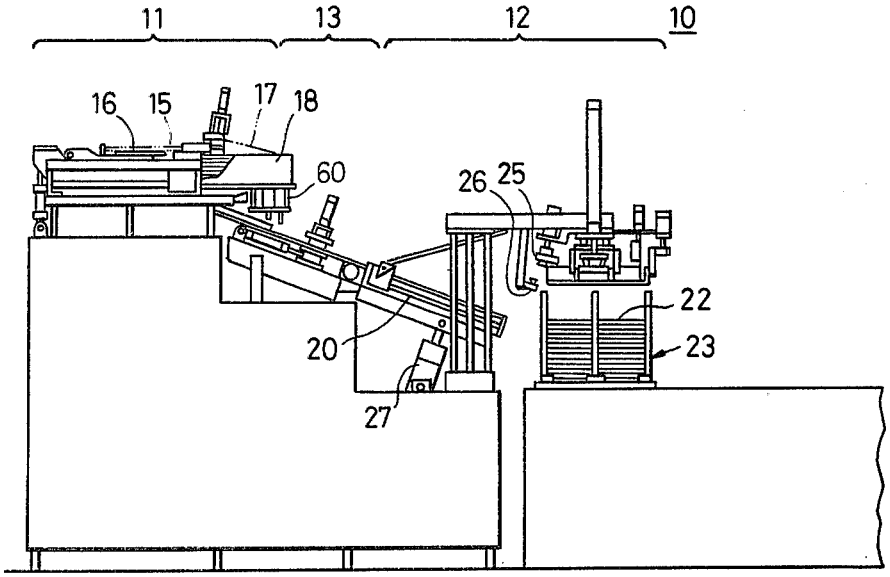
FIGS. 1 and 2 are a front view and a plan view, respectively, showing the overall general organization of one embodiment of an automatic record disc packing apparatus according to the present invention.
Figure 2:
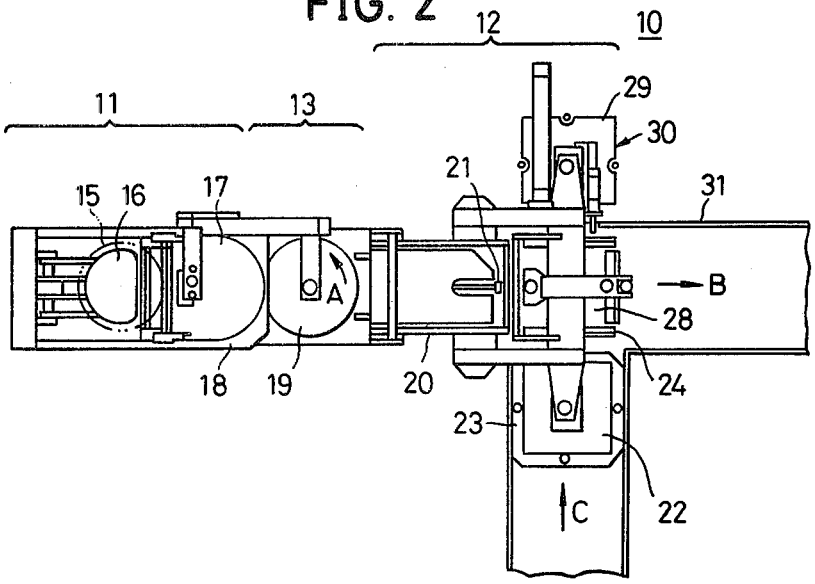

Referring to FIG. 1 and FIG. 2, general description is given to the process for automatically packing record discs. An automatic record disc packing apparatus 10 generally comprises a mechanism 11 for putting inner bags on bare record discs to form provisionally packed record discs, a mechanism 12 for inserting the provisionally packed record discs into empty jackets, and a mechanism 13, disposed between the mechanisms 11 and 12, for turning of the provisionally packed record discs by 90°.

Each finished record disc 15 is carried to and placed on a record carrying table 16 by an appropriate transport device. Following this, an operation for drawing an inner bag 17 over the record disc 15 is initiated. This operation is performed in a manner such that the bare record disc 15 is kept stationary on the carrying table 16, and the inner bag 17 moves so as to cover the record disc 15, thus forming a provisionally packed record disc. A large number of inner bags 17 are stacked inside a stock magazine 18. When the above operation is complete, the carrying table 16 is inclined so that the provisionally packed record disc slides downward. This provisionally packed disc arrives on a turntable 19, where it is turned in the direction indicated by arrow A by 90° so that the unsealed side of the inner bag 17 intersects at right angles with the open side of an empty jacket described hereafter. The so reoriented provisionally packed record disc again starts to slide downward to a section 20 for transporting the provisionally packed record disc for insertion into an empty jacket, where it is engaged by a stop member 21.

A number of empty jackets 22 are stacked and accommodated inside a stock section 23. The topmost empty jacket 22 is picked out and supported by side guides 24 and then moved to a center position where a provisionally packed record disc is to be inserted thereinto. At this position, the top and bottom surfaces of the empty jacket 21 are drawn by suction members 25 and 26, respectively, and the unsealed edge of the empty jacket 21 is thereby opened.

The transporting and inserting section 20, supporting the provisionally packed record disc thereon, is titled upward by an actuation cylinder 27 to a position opposing the empty jacket 21 supported at the position mentioned above. Then, the transporting and inserting section 20 moves together with the provisionally packed record disc and enters the empty jacket 22. When the provisionally packed disc has fully enterd the jacket 21, a mechanism is actuated to clamp only the provisionally packed record disc through the jacket 22, and then the section 20 is returned to its original position, leaving the provisionally packed record disc inside the jacket 22. This completes the record disc packing operation.

Then, the jacket containing the provisionally packed record disc (referred to as a "complete record disc package") is set free and allowed to drop, and is stacked in a stock section 28. Each time a prescribed number of complete record disc packages newly accumulates in the stack, a reinforcement plate 29 is transferred from a stock section 30 and is placed on the stack of complete packages and the succeeding complete package in stacked thereon. This reinforcement plate 29 serves to prevent the stacked record discs from adverse deformation and warp.

When a specific number of complete record disc packages have accumulated on the stock section 28, the stock section 28 is moved in the direction indicated by an arrow B along a passage 31, and the empty stock section 23 is shifted in the arrow direction C to the position for receiving the complete record disc packages.

Next, the individual packing processes are described in more detail.

Process For Covering Bare Record Discs With Inner Bags: (FIG. 3, FIG. 4, FIGS. 5(A) through 5(L))

The inner bag stock magazine 18 is of detachable structure and is attached to an apparatus structure with a large number of inner bags 17 stacked therein and with the unsealed edges 17*a* thereof confronting the record carrying table 16.

The mechanism 11 is supported on a bed 40 and is disposed at a higher position than the other sections of the packing apparatus 10.

Figure 3:
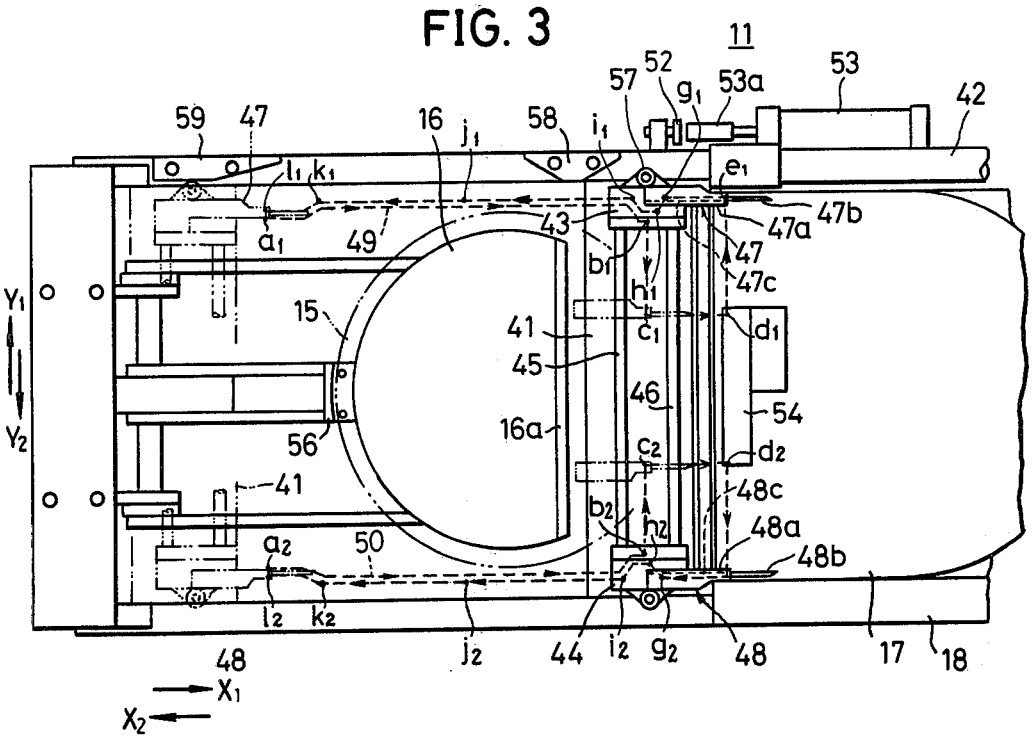
FIGS. 3 and 4 are a plan view and a rear view, respectively showing a mechanism for drawing inner bags over bare record discs.
Figure 4:
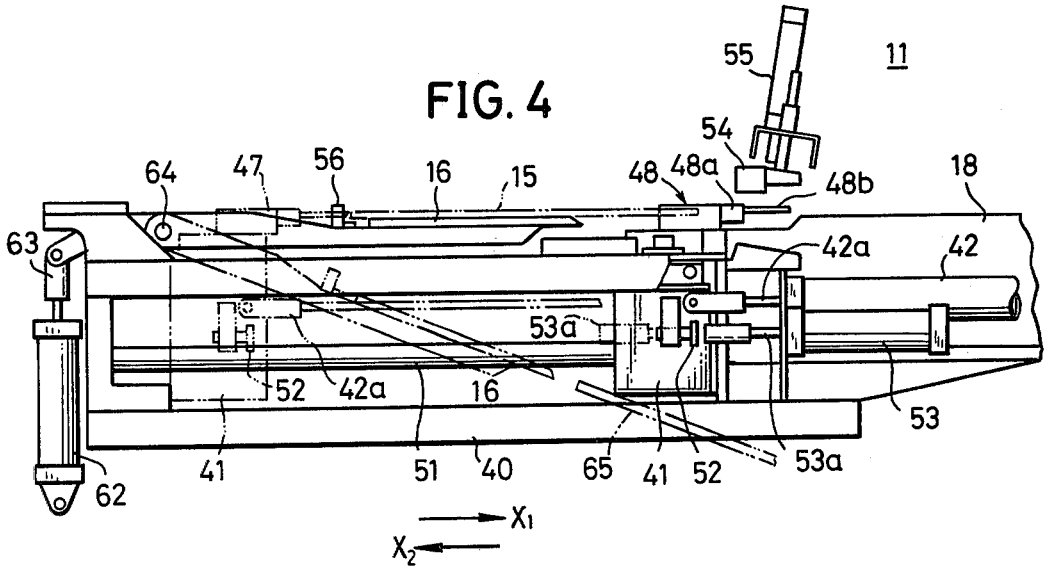

Prior to operation, a moving base 41 is at the position indicated by two-dot chain lines in FIGS. 3 and 4, and the record carrying table 16 is held horizontal. The moving base 41 is connected with a rod 42*a* of an actuation cylinder 42 and is adapted to move in the directions indicated by arrows X1 and X2 along guide rods 51 responsive to actuation of the cylinder 42. Above the missing base 41, are movably supported a set of arm holders 43 and 44 on a pair of guide rods 45 and 46. The arm holders 43 and 44 are adapted to be driven in the arrow directions Y1 and Y2 in a symmetric relationship by means of a rack-and-pinion mechanism (not shown). The arm holders 43 and 44 have arm members 47 and 48 mounted theron, respectively. The arm members 47 and 48 are respectively comprised on large-diameter column shaped proximal arms 47*a* and 48*a*, and small-diameter column shaped distal arms 47*b* and 48*b*. Moreover, V-shaped grooves 47*c* and 48*c* (refer to FIG. 15) are respectively formed in the arm members 47 and 48 on their surfaces opposing each other. The above described sturcture of the arm members 47 and 48 makes it possible to smoothly and reliably carry out the operation of covering the record disc with the inner bag, as will be described later.

During the process of inserting the record disc in the inner bag, the arm members 47 and 48 respectively follow loci 49 and 50 indicated in bold broken lines, while the bare record disc 15 remains stationary on the carrying table 16.

The operation of placing the record disc in the inner bag generally comprises an operation for supporting the empty inner bag 17 with its unsealed side opened by the pair of arm members 47 and 48 (FIGS. 5(A) through 5(E)), and an operation for moving the supported inner bag 17 to envelop the record disc 15 (FIGS. 5(F) through 5(L)).

Figure 5:
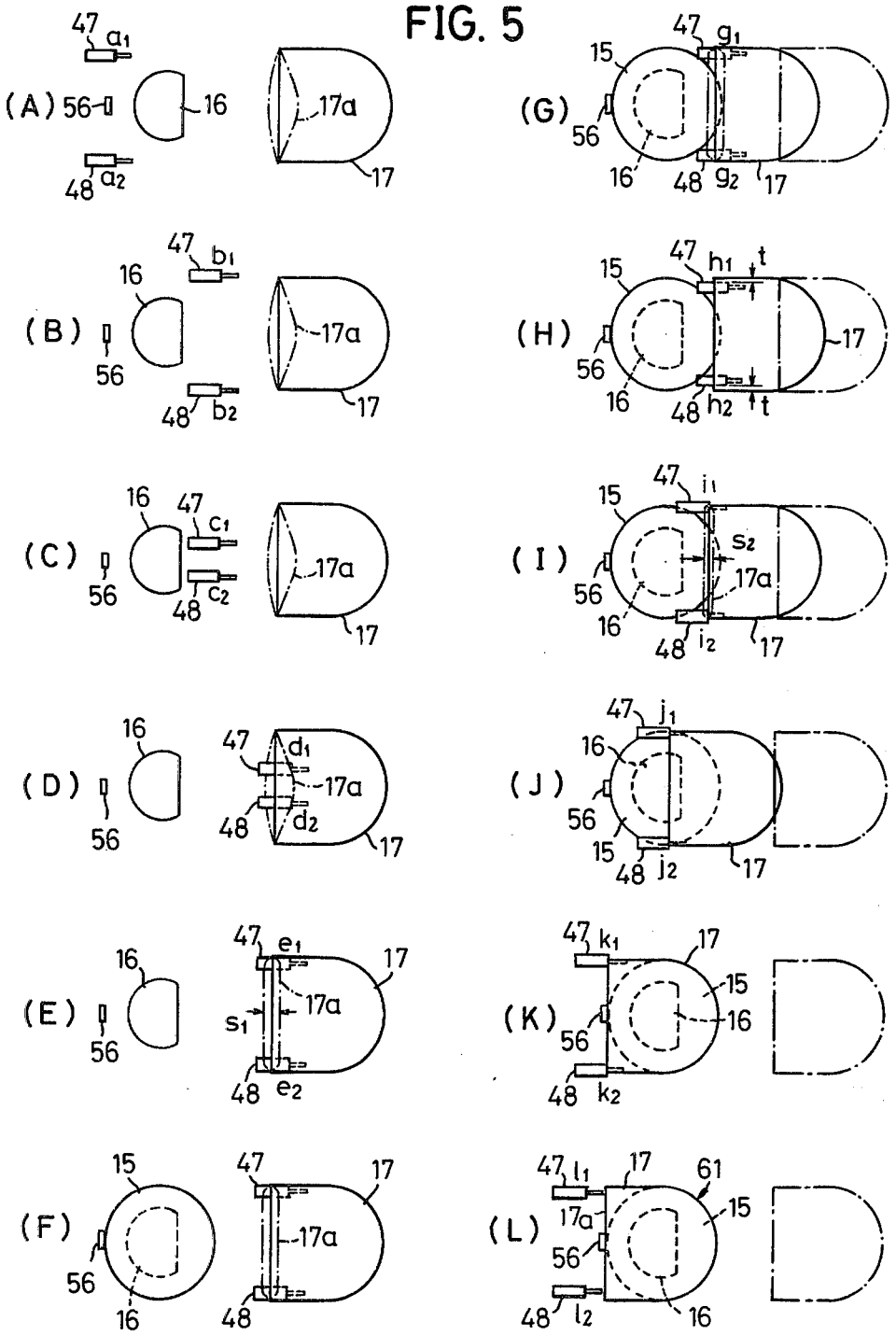
FIGS. 5(A) through 5(L) are illustrations showing stops in the process of drawing an inner bag over a record disc.

Prior to the packing operation, the arm members 47 and 48 are respectively located at positions a1 and a2 (FIG. 5(A)). A suction member 54 is operated to attract the upper sheet near unsealed edge of the inner bag 17 at the uppermost position and is pulled upward by a cylinder 55. Accordingly, the unsealed edge 17*a* of the inner bag 17 is opened with its upper sheet pulled upward and its lower sheet hanging downward, as indicated by two-dot chain lines in FIG. 5(A).

In the packing operation, the actuation cylinder 42 operates to move the moving base 41 together with the arm members 47 and 48 in the arrow direction X1. As the base 41 moves, a stop member 52 fixed on the lateral surface of the base 41 comes to abut against a rod 53*a* projecting from an actuation cylinder 53 as indicated by two-dot chain lines in FIG. 4, thus bringing the arm members 47 and 48 to a temporary stop at positions b1 and b2 (FIG. 5(B)).

After it has been confirmed that the arm members 47 and 48 have stopped, another actuation cylinder (not shown) is operated so that the arm members 47 and 48 respectively move in the arrow directions Y2 and Y1 and approach each other finally reaching positions c1 and c2 (FIG. 5(C)).

In this state, the actuation cylinder 53 is rendered inoperative, and the moving base 41 is again moved further in the arrow direction X1 by the actuation cylinder 42. The arm members 47 and 48 pass through opened free edge 17*a* to enter the inner bag 17 and reach positions d1 and d2. Then, the above-mentioned actuation cylinder (not shown) is operated in the reverse direction so that the arm members 47 and 48 are shifted so as to separate from each other up to positions e1 and e2. The suction member 54 terminates suction operation. As a consequence, the empty inner bag 17 is engaged from the inside at the lateral ends of the unsealed edge 17*a* by the proximal arms 47*a* and 48*a*. As the proximal arms 47*a* and 48*a* are at this time urged away from each other, the inner bag 17 is supported and stretched as indicated in FIG. 5(E). Here, since the proximal arms 47*a* and 48*a* have a large diameter, the upper sheet and the lower sheet of the inner wrapper 17 are separated from each other by a distance s1 which is sufficiently larger than the thickness of the record disc so as to insure positive initiation of the operation of covering the record disc as described later. Further, the large diameter the proximal arms 47*a* and 48*a* assures that the inner bag is safe from tearing at its latelal ends. The mechanism 11 now assumes a stand-by state, as indicated in FIG. 3.

While the mechanism 11 is in this stand-by state, a bare record disc 15 is transferred by a device (not shown) from a stock section (not shown) and is placed on the semicircular record carrying table 16 (FIG. 5(F)). The record disc 15 placed on the carrying table 16 is positively restricted of its movement in the arrow direction X2 by an L-shaped stom member 56 abutting the edge of the record disc 15 on its left side as viewed in FIGS. 3 and 4.

Whereupon it has been confirmed that a record disc 15 has been placed on the carrying table 16, the actuation cylinder 42 is actuated to move the moving base 41, the arm members 47 and 48, and the inner bag 17 supported between the arm members 47 and 48 in the direction indicated by arrow X2. The record disc 15 to be covered is centered with the widely opened unsealed side 17*a* of the inner bag 17. As the arm members 47 and 48 move to their respective positions g1 and g2, the upper sheet and the lower sheet of the inner bag 17 move smoothly over the upper and lower surface of the record disc 15 without striking into the edge thereof. Accordingly, the inner bag 17 is drawn over the right side of the record disc 15 (the effect being the same as the insertion of the record disc into the bag), as indicated in FIG. 5(G).

When the inner bag 17 has come to cover the record disc 15 to a certain extent, a cam roller 57 of the arm holder 43 begins to follow a trapezoidal cam 58. As the cam roller 57 follows the cam 58, the pair of arm members 47 and 48 first move somewhat toward each other and then apart again as they both move in the direction arrow Y2.

The positions of the arm member 47 and 48 when they have moved toward each other are indicated as h1 and h2 in FIG. 5(H) and at this time they separate from the lateral inner edges of the inner bag 17 to release the bag from it stretched condition. That is, gaps t are formed between the proximal arms 47*a* and 48*a* and the associated lateral inner edges of the inner bag 17. Therefore, during the following movement of the moving base 41, the inner bag 17 is held at the position indicated in FIG. 5(H), and only the arm members 47 and 48 move in the direction indicated by arrow X2 independent of the inner bag 17. As the cam roller 57 rides over the cam 58, the arm members 47 and 48 respectively reach positions i1 and i2 and again operate to support the inner bag 17 in a stretched condition between the distal arms 47*b* and 48*b*, as indicated in FIG. 5(I). Since the distal arms 47*b* and 48*b* have small diameters, the unsealed side 17*a* of the inner bag 17 is narrowed to a width s2 and indicated by two-dot chain lines, and the arm members 47 and 48 move further in directions of arrows Y1 and Y2 from their positions in the lateral direction indicated in FIG. 3. The outside surfaces of distal arms 47*b* and 48*b* are made circular to minimize the danger of tearing the inner bag 17 at the lateral edges thereof.

Thereafter, the inner bag 17 moves together with the moving base 41 in the direction of arrow X2 as it is stretched between the distal arms 47*b* and 48*b*, and the record disc 15 is in effect inserted into the inner bag 17.

The arm members 47 and 48 pass by opposite edges of the record disc 15. As they pass by, the V-shaped grooves 47*c* and 48*c* of the arm members 47 and 48 cooperate to restrict the record disc 15 from displacement in the directions of arrows Y1 and Y2. The lower sheet of the inner bag 17, which is in the vicinity of the lower surface of the record disc 15, is guided by an inclined surface 16*a* of the table 16 to smoothly slip between the record disc 15 and the table 16. FIG. 5(J) shows this stage of the operation.

When the arm members 46 and 47 reach the positions k1 and k2, the inner bag 17 completely covers the record disc 15, as indicated in FIG. 5(K). That is, the stationary record disc 15 is, in effect, fully inserted into the inner bag 17 by the motion of the inner bag 17 relative to the record disc 15.

The moving base 41 further moves in the arrow direction X2 and returns to its original position indicated by two-dot chain lines in FIG. 3. During this movement the cam roller 57 rides on a wedge-shaped cam 59, and the arm members 47 and 48 are thereby shifted to positions l1 and l2 (i.e., positions a1 and a2) and approach each other to some extent. Accordingly, the stretching and supporting action of the distal arms 47*b* and 48*b* on the bag 17 is released.

As a result, there is obtained a record disc 15 covered with an inner bag 17, that is, a provisionally packed record disc 61. This provisionally packed record disc 61 rests on the table 16 and is free to move in the direction of arrow X1.

In the above described packing process, the arm member 47 is allowed to move smoothly through the positions g1→h1→i1 without adversely contacting the record disc 15 by the presence of the above-described V-shaped groove 47*c*. The same can be said of groove 48*c* and the other arm member 48.

The semi-circular shape of the carrying table 16 allows table to be disposed near the bag stock magazine 18, reducing the size of the mechanism 11.

Interrelatedly with the above described packing operation, a level maintaining device 60 (FIG. 1) operates to gradually push up the stack of bags inside the magazine 18 so as to maintain the position of the topmost bag at a constant level. Moreover, when, as described hereinafter, the provisionally packed record disc is transferred from the section 11, the suction member 54 and the cylinder 55 operate again to open the unsealed side of the next inner bag as indicated in FIG. 5(A).

The operation set forth above makes it possible to have a bare record disc 15 accommodated within an inner bag 17 completely free from any damage on the record surface. Following this operation, the record disc 15 will be transferred to next stage by sliding on a plate. However, since the record disc 15 has been accommodated within the bag 17, the record disc 15 is safe from damage to its surface during transport.

Figure 6:
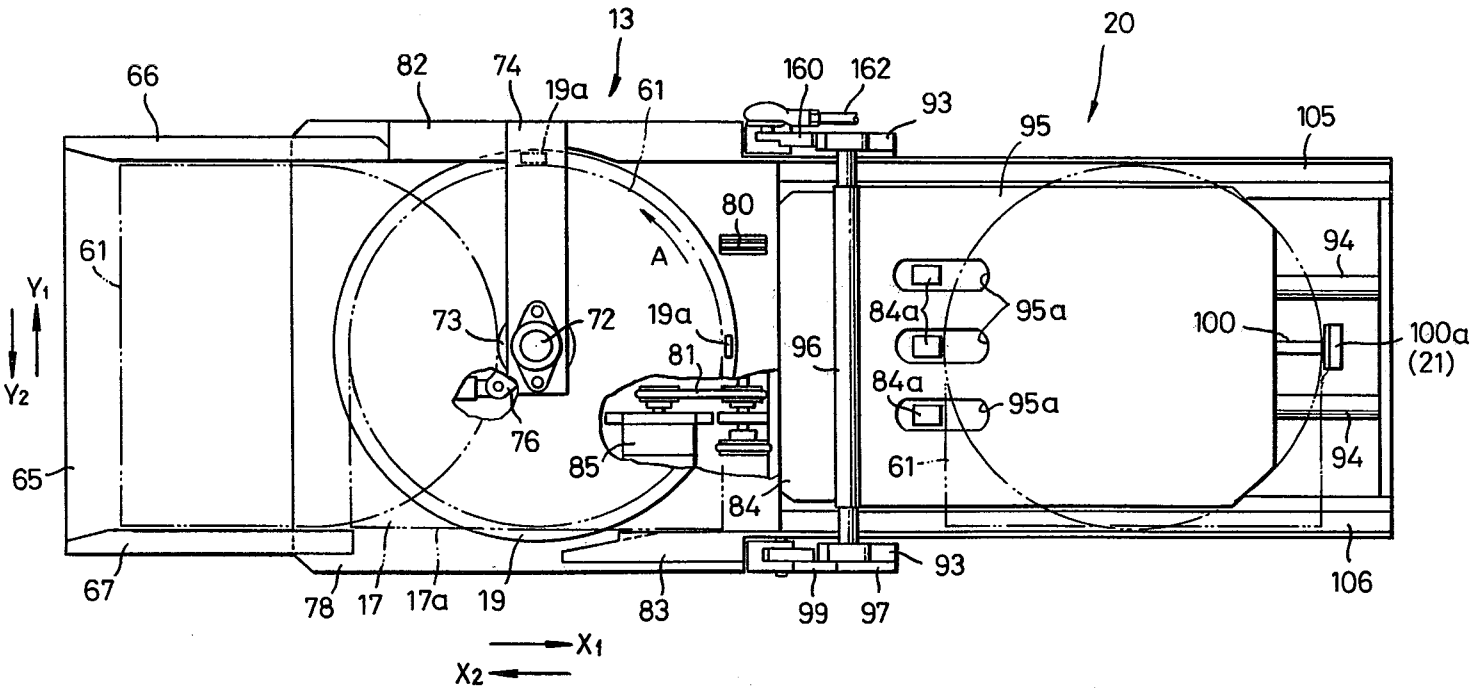
FIGS. 6 and 7 are a plan view and a front view, respectively showing mechanisms for turning the provisionally packed record discs by 90° and for inserting said provisionally packed record discs into empty jackets.
Figure 7:
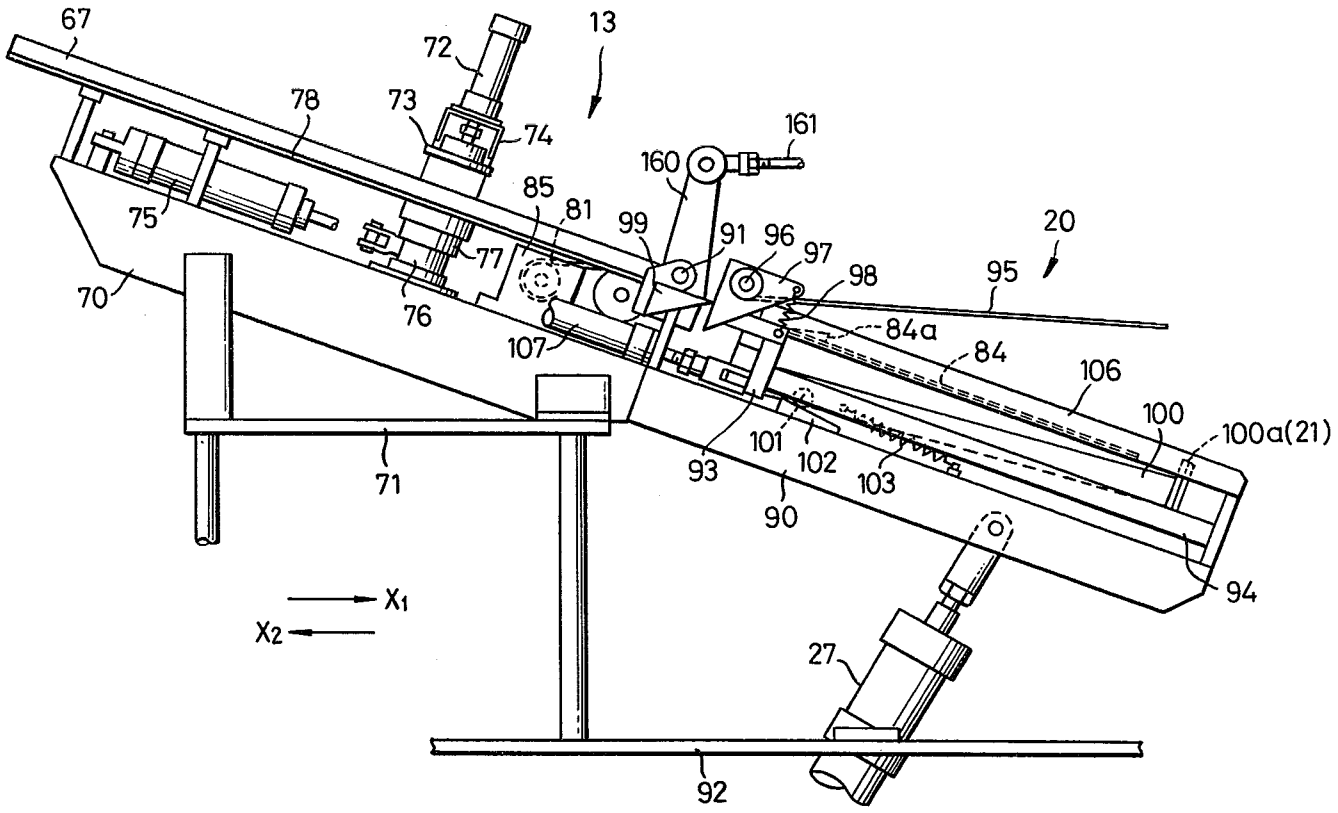

Process For Transferring The Provisionally Packed Record Disc To The Following Stage: (FIGS. 4, 6, and 7)

Upon return of the moving base 41 to its original position, an acutation cylinder 62 is operated to cause its rod 63 to move upwardly. The upward movement of the rod 63 causes the table 16 to pivot about a support shaft 64 until its degree of inclination comes into alignment with a descending slide 65, as indicated by two-dot chain lines in FIG. 4. As the table 16 descends, the provisionally packed record disc 61 slides toward the direction indicated by arrow X1 and leaves the section 11. It then slides on the slide 65 guided by opposing guide rails 66 and 67, and finally arrives on a rotary table 19. The table 16 is thereafter restored to its original horizontal position.

Process For Turning The Provisionally Packed Record Disc By 90 Degrees; (FIGS. 6 and 7)

The section 13 is mounted on an inclined bed 70 supported by a support frame 71.

Interrelatedly with the operation of inclining the record carrying table 16, an actuation cylinder 72 is operated to lower a stop member 73 until it comes in contact with the rotatable table 19. The cylinder 72 is mounted on a support arm 74.

The provisionally packed record disc 61 slides down the slide 65 and a slide 78 until it comes to abut against a rubber stop member 73 and is temporarily stopped. Then, the stop member 73 is pulled upward by the cylinder 72 to free the provisionally packed record disc 61, which resumes sliding in the direction of arrow X1 and comes to abut against a stop lug 19*a*. The provisionally packed record disc 61 thus comes to a stop on the rotatable table 19. Here, since the provisionally packed record disc 61 has been stopped temporarily at a position preceding the stop lug 19*a*, it abuts against the stop lug 19*a* with little impact force so that it does not bounce and therefore maintains proper positioning on the rotatable table 19. Moreover, there may preferably by provided, at a position immediately before the position where the provisionally packed record disc 61 comes to abut against the stop lug 19*a*, an additional device for holding down the provisionally packed record disc 61.

Thereafter, the rubber stop member 73 is lowered by the cylinder 72 to clamp the provisionally packed record disc 61 on the rotatable table 19.

Then, an actuation cylinder 75 is actuated and the rotatable table 19 is thereby turned by way of an arm 76 and a rotatable shaft 77 by about 90 degrees in the direction indicated by arrow A. The provisionally packed record disc 61 is turned together with the rotatable table 19 so as to bring the unsealed side 17*a* of the bag 17 to face in the direction of arrow Y2, as indicated by two-dot chain lines in FIG. 6.

After the direction of the provisionally packed record disc 61 has been changed, the stop member 72 is lifted to release the provisionally packed record disc 61 from clamped state. Since the lug 19*a* is now located at the position indicated by two-dot chain line in FIG. 6, the provisionally packed record disc 61 resumes sliding on the rotatable table 19 and the slide 78 in the direction indicated by arrow X1.

After having slid some distance, the provisionally packed record disc 61 rides onto a pair of endless driving belts 80 and 81 which project somewhat above the slide 78 and is transferred positively in the same direction by means of endless belts 80 and 81. The provisionally packed record disc 61 is guided at its lateral sides with respect to its moving direction and is moved onto a bottom plate 84. The pair of endless driving belts 80 and 81 are continuously driven to run by means of a motor 85.

Process For Packing The Provisionally Packed Record Disc Into An Empty Jacket: (FIGS. 6 and 7)

In the transporting and inserting section 20, a bed 90 is rotatably supported on section 13 at its one end by a shaft 91. The bed 90 remains inclined as indicated in FIG. 7 prior to the operation of section 20.

A moving base 93 is adapted to move along a pair of guide rods 94 in the directions indicated by arrow X1 and X2. The bottom plate 84 is secured at a longitudinal end thereof to the moving base 93. A cover plate 95 is fixed at a longitudinal end thereof to a rotatable shaft 96 supported transversely above the moving base 93. This rotatable shaft 96 is urged to rotate clockwise by a coil spring 98 stretched between a triangular arm member 97 fixed to the shaft 96 at the end thereof and the moving base 93. In the state indicated in FIG. 7, the arm member 97 is engaged by a cam 99 secured to the section 13, whereby the shaft 96 is turned counterclockwise and the top plate 95 is inclined upward.

Figure 8:
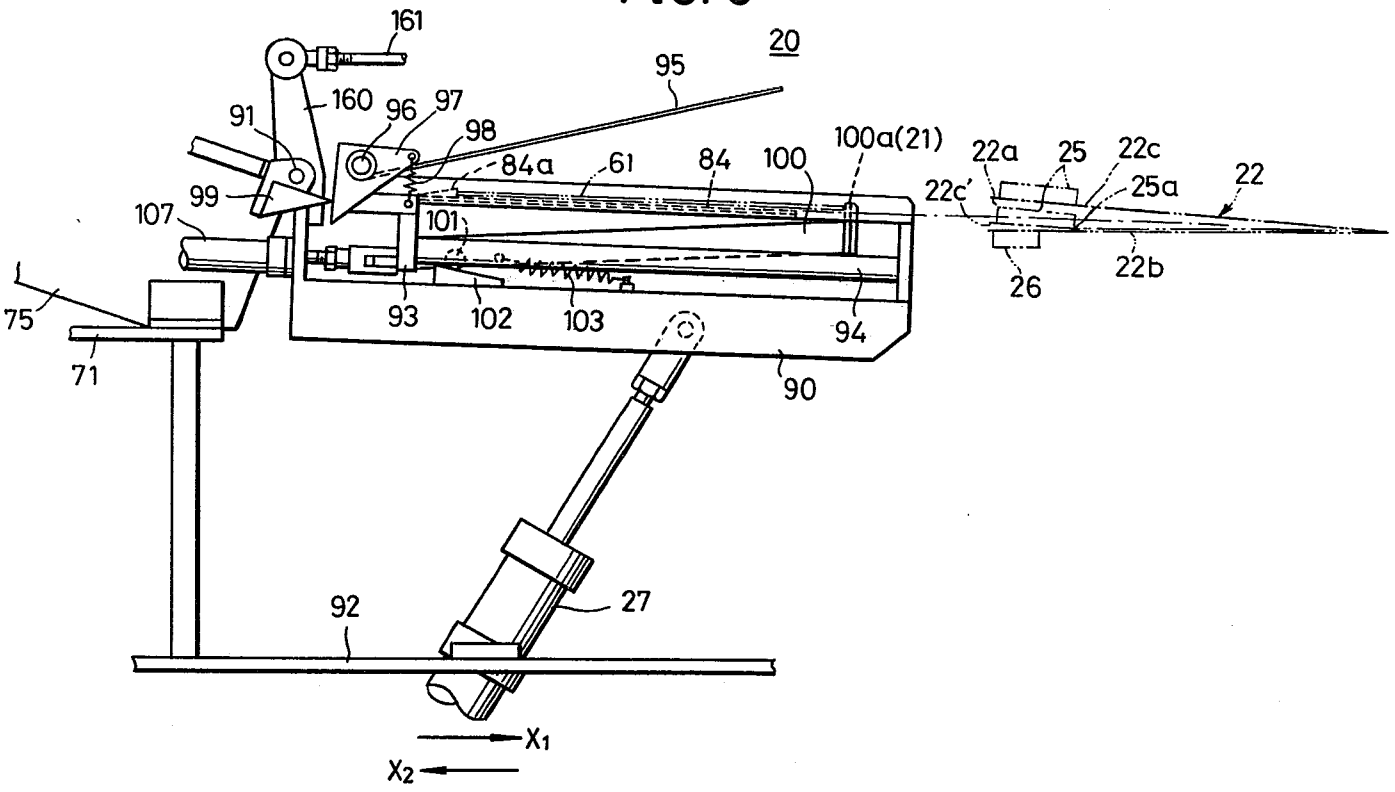
FIGS. 8 and 9 are front views of the inserting mechanism indicated in FIG. 7 during inserting operation.

A stop arm 100 having at the distal end thereof a stopper 100*a* (21) is adapted to more over a small distance in the arrow directions X1 and X2 responsive to movement of the moving base 93. In the state indicated in FIG. 7, the stop arm 100 is shifted in the arrow direction X1 and turned upward counter to a spring 103 by action of a cam roller 101 rising on a cam 102. This puts the stopper 100*a* in its operational position.

the provisionally packed record disc 61 slides on the bottom plate 84 and rides over wedge-shaped projections 84*a*, its orientation (the unsealed edge facing in the direction of arrow Y2) being maintained by laterally opposite L-shaped guide rails 105 and 106. The provisional package 61 abut against the stopper 100*a* (21) and stops. Thereafter, an actuation cylinder 27 is rendered operative to cause the entire transporting and inserting section 20 to turn upward as indicated in FIG. 8. Interrelatedly with the turning of the section 20, an empty jacket 22 is opened at separate position, as described further below. The section 20 is set with respect to the opposing empty jacket 22 so that a hypothetical extension (indicated by single-dot chain line) of the upper surface of the bottom plate 84 passes through the center of the opened unsealed side of the jacket 22. At this time the provisionally packed record disc 61 is engaged at its edge in the direction of arrow X1 by the stopper 100*a* and at its edge in the direction of arrow X2 by the wedge-shape projections 84*a*.

Figures 9, 12:
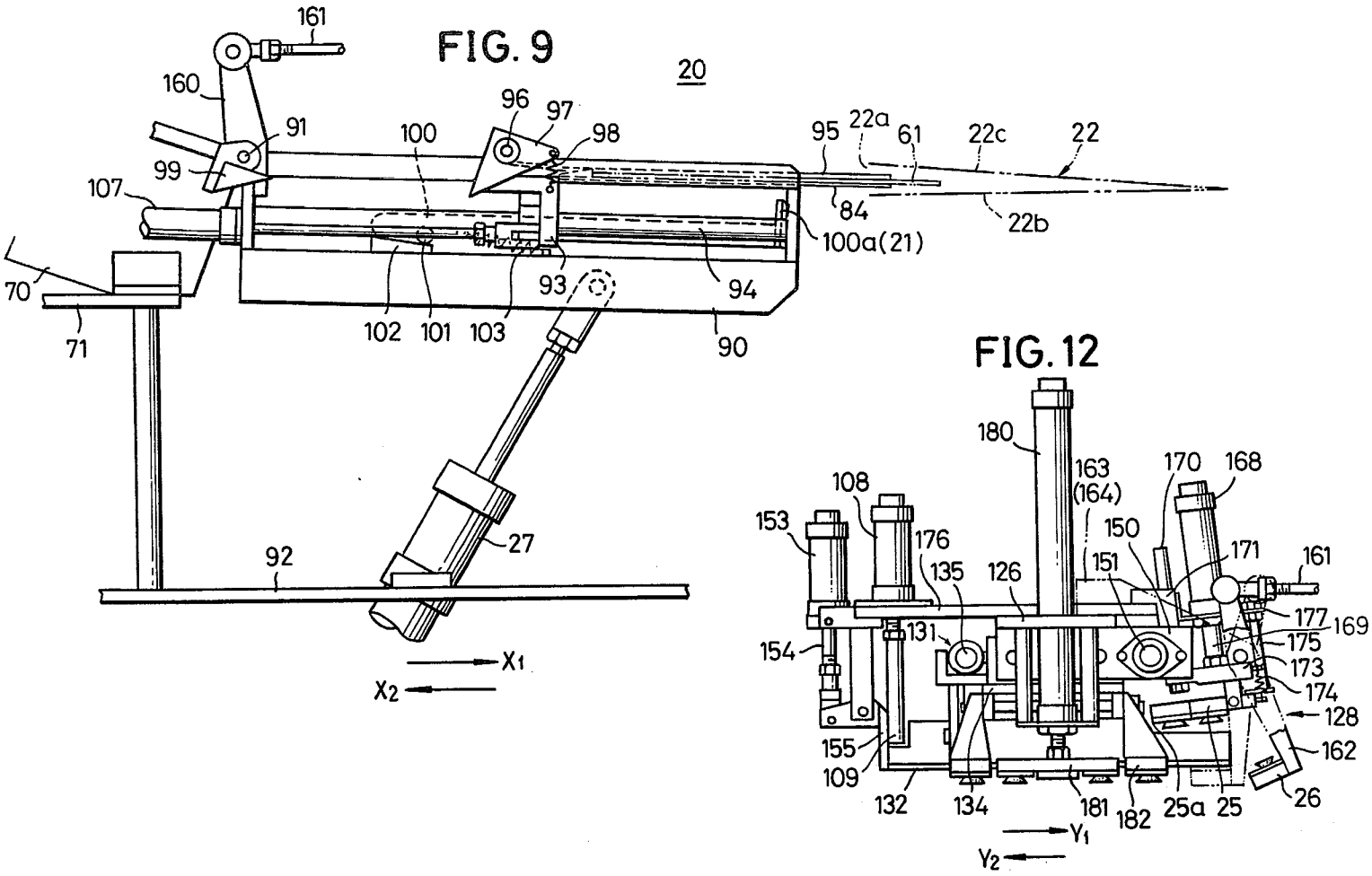
FIGS. 10, 11, and 12 are respectively a plan view, a side view, and a rear view, showing a mechanism section including a mechanism for successively holding empty jackets at a place where the provisional record disc packages are inserted thereinto, a mechanism for opening the unsealed sides of the empty jackets, and a mechanism for transporting reinforcement plates.

Then, an actuation cylinder 107 is operated to move the moving base 93 in the direction of arrow X1 (FIG. 9). As the moving base 93 moves, the stop arm 100 shifts in the arrow direction X1 and further turns clockwise as the cam roller 101 descends along the slant surface of the cam 102, under the force of the spring 103. Accordingly, the stopper 100*a* descends and is retracted from the path along which the provisionally packed record disc 61 is to be transferred.

In addition, as the moving base 93 moves, the arm member 97 is released from engagement with the cam 99 and the cover plate 95 is turned clockwise by the action of the spring 98 thereby to clamp the provisionally packed record disc 61 between itself and the bottom plate 84. The cover plate 95 is provided with openings 95*a* at positions confronting the projections 84*a*.

Therefore, the provisionally packed record disc 61, while being clampled with light pressure between the bottom plate 84 and the cover plate 95 and further while being prevented from moving in the direction of arrow X2, is transferred in the direction of arrow X1, that is, toward the opened unsealed edge of the jacket 22, and is inserted into the jacket 22.

When the provisionally packed record disc 61 has been fully inserted into the jacket 22, an actuation cylinder 108 is operated to descend a clamp rod 109 which clamps, between itself and a support arm 155 described later (FIG. 12), the provisionally packed record disc 61 at the end thereof which projects from between the bottom and cover plates 84 and 95. The provisional package is, of course, not clamped directly but through the jacket 22. Thus, when the moving base 93 moves in the direction of arrow X2, only the bottom and cover plates 84 and 95 return, and the provisionally packed record disc 61 remains inside the jacket 22.

Accordingly, the provisionally packed record disc 61 is accommodated within the jacket 22, whereby there is obtaining a complete record disc package 110.

After the moving base 93 has returned to its original position, the cylinder 27 is operated to return the transporting and inserting section 20 to its original position as illustrated in FIG. 7.

Process For Opening the Empty Jacket: (FIGS. 8 through 12)

Figure 11:
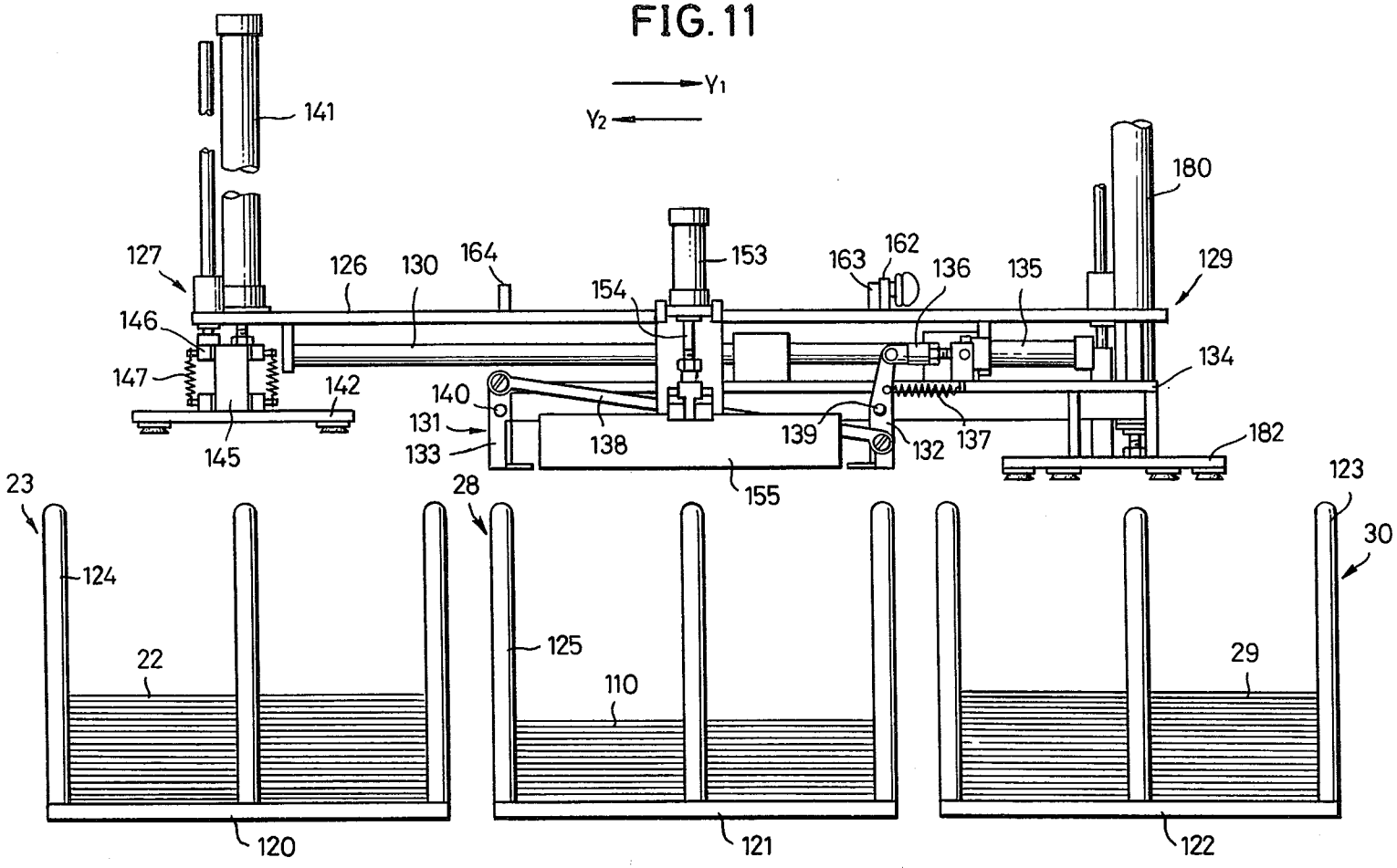

As shown in FIG. 11, the sections 23, 28, and 30 are disposed side by side and each is constructed of a pallet (120, 121 or 122) having four guide rods (123, 124 or 125) standing vertically thereon, one guide rod being fixed to each side of the pallet. The stock section 23 contains a predetermined number of empty jackets 22 stacked with the unsealed sides thereof facing in the direction of arrow X2. The stock section 28 contains the completed record disc packages 110 which are stacked therein as will be described further below. The stock section 30 contains a stack of reinforcement plates 29.

Above the stock sections 23, 28 and 30, there is disposed a transverse support frame 126 which is provided with an empty jacket suction mechanism 127 (above stock section 23), an empty jacket opening mechanism 128 (above stock section 28), and a reinforcement plate suction mechanism 129 (above stock section 30).

Figure 10:
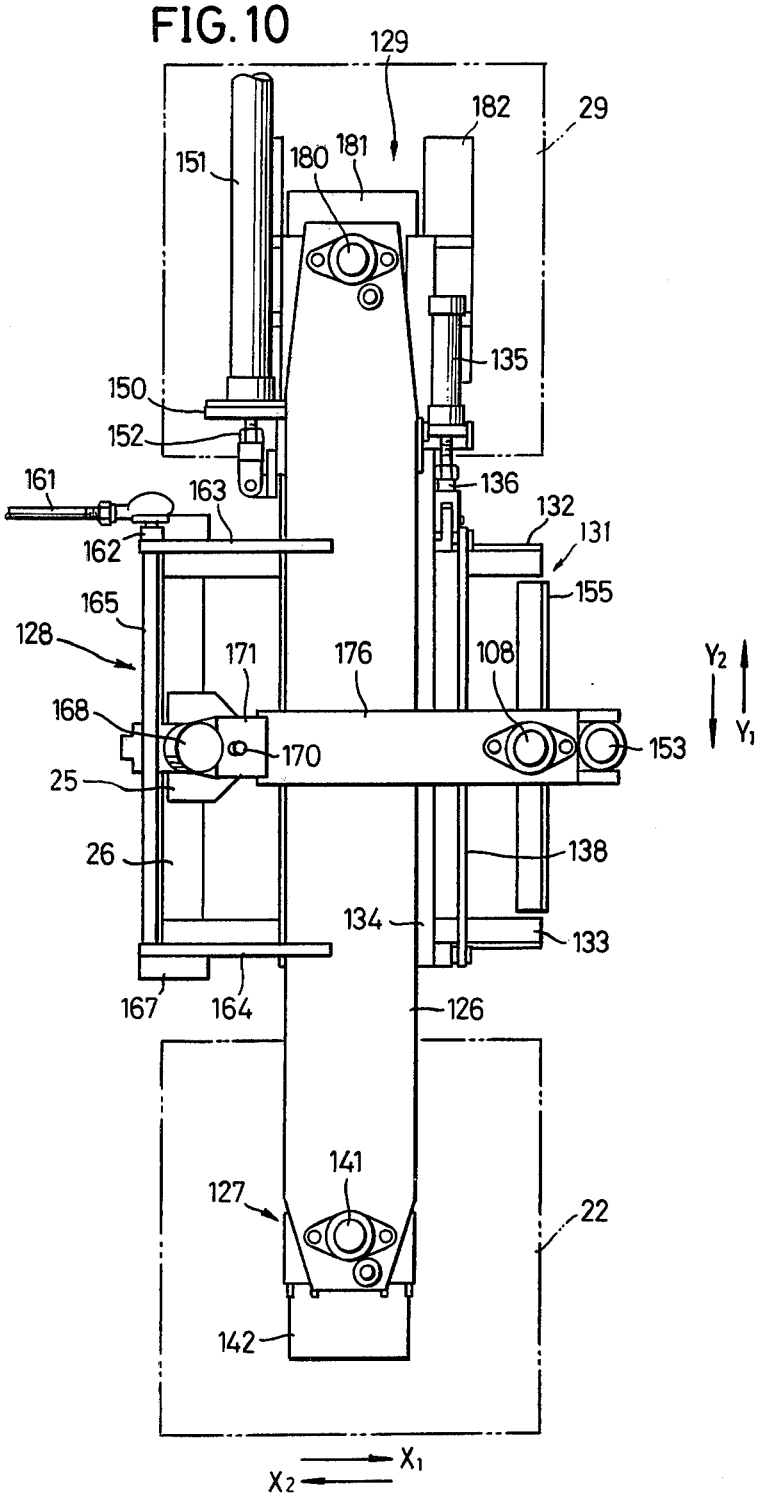

On guide rods 130 below the support frame 126, there is supported a mechanism 131 for carrying the empty jackets and the reinforcement plates in the directions indicated by arrows Y1 and Y2. FIGS. 10 and 11 show the carrying mechanism 131 shifted in the direction of arrow Y1.

When an empty jacket is to be removed from the stock section 23, the carrying mechanism 131 is shifted in the direction of arrow Y2 to bring a jacket carrying section comprised of pair of L-shaped support arms 132 and 133 into position above the stock section 23. A cylinder 135 mounted on a base plate 134 of the carrying mechanism 131 is actuated to move a rod 136 in the direction of arrow Y2 counter to the force of a coil spring 137, thus causing the L-shaped support arms 132 and 133 to rotate counterclockwise and clockwise about pins 139 and 140 through a linkage 138. This rotation causes the support arms 132 and 133 to separate from each other.

When an empty jacket is to be picked up, a cylinder 141 of the mechanism 127 is operated to lower a suction member 142 into contact with the top side of an empty jacket 22. When it has been confirmed that the empty jacket 22 has been drawn into contact with the suction member 142, the suction member 142 is lifted together with the empty jacket 22 to its original uppermost position. The empty jacket 22 is raised above the level of the open support arms 132 and 133. Next, the cylinder 135 is rendered inoperative, allowing the support arms 132 and 133 to be closed by the force of the coil spring 137. Then, the sucking action of the suction member 142 is discontinued to release the empty jacket 22, which thereupon drops to be caught and supported at its sealed right and left sides by the support arms 132 and 133.

A mechanism consisting of a link arm 145, a plate 146, and a spring 147 supports the suction member 142 in a swingable manner so as to insure the above described drawing action even in the case where the topmost empty jacket 22 is inclined out of horizontal.

Following this, an actuation cylinder 151 secured to a flange part 150 of the support frame 126 is operated to retract its rod 152. The carrying mechanism 131 is thereby moved in the arrow direction Y1 together with the empty jacket 22. When this empty jacket 22 has come directly above the stock section 28, a cylinder 153 is operated to push its rod 154 downward, thus causing an L-shaped support arm 155 to turn counterclockwise as viewed in FIG. 12 thereby to support the edge of the empty jacket 22 opposite its opening.

Accordingly, the empty jacket 22 is supported at its sealed right and left edges and its bottom edge by means of the support arms 132, 133, and 135, and is kept in its stand-by position ready to accommodate the provisionally packed record disc 61 therein, and thereafter has its unsealed side opened.

As the empty jacket 22 is kept in the stand-by position, the empty jacket opening mechanism 128 operates interrelatedly the transporting and inserting section 20. An arm 160 of the section 20 turns counterclockwise together with the upward rotation of the section as indicated in FIG. 8 and this motion is transmitted via a connecting rod 161 to cause an arm 162 of the mechanism 128 rotate clockwise to the position indicated by two-dot chain lines in FIG. 12. One end of the arm 162 is secured to a rotatable shaft 165 which is in turn supported between a pair of support arms 163 and 164. The lower suction member 26 is provided so as to extend between the arm 162 and an arm 167. When the arm 162 is turned, the suction member 26 moves beneath the empty jacket 22 and makes contact therewith.

When the suction member 26 moves beneath the empty jacket 22, a cylinder 168 is operated to push its rod 169 downward thereby to move the upper suction member 25 downward. This downward operation is helped by a guide rod 170 guided by a guide block 171. The suction member 25 is pivotally supported at a part near one end thereof on a support block 173 fixed to the rod 169, and is urged to turn counterclockwise by a spring 174. Therefore, the suction member 25 is kept at an inclined position where it is engaged with a stop member 175. The guide block 171 and the cylinder 108 are mounted on a support plate 176 which is fixed to the transverse support frame 126 at right angles therewith, and the cylinder 168 and the stop member 175 are provided on a flange 177 fixed to the guide block 171. The suction members 26 and 25 respectively make contact with the lower sheet **22*b* and the upper sheet 22*c* of the empty jacket 22. When it has been confirmed that the sheets 22*b* and 22*c* have been drawn into contact with the associated suction members, the suction member 25 is lifted by the cylinder 168. The top cover 22*c* is pulled upward by the suction member 25, while the bottom cover 22*b* is kept horizontal by the sucking action of the suction member 26, whereby the unsealed side 22*c* of the empty jacket 22** is opened.

When the suction member 25 makes contact with the top cover **22*c* of the empty jacket 22, it rotates clockwise to assume a horizontal position where it is urged to turn counterclockwise by means of the spring 174. Therefore, as the suction member 25 is lifted, it firstly rotates somewhat counterclockwise under the force of the spring 174 and then ascends in the inclined posture, as indicated in FIG. 8. When the suction member 25 is turned somewhat counterclockwise, an edge part 25*a* thereof pushes down the top cover 22*c* and the part opposite to the edge part 25*a* pulls the top cover upward, whereby the top cover 22*c*** assumes the state indicated by 22*c*′ where only the part near the unsealed sides **22*a*** is pulled upward.

Since the operation of opening the jacket 22 is carried out by way of the above described initial operation, any sheet of paper or the like which may have been inserted into the jacket 22 beforehand will be caused to lie on the inside of the bottom cover when the jacket 22 is opened.

The provisionally packed record discs 61 are inserted into the opened empty jackets 22 as described above.

Process For Stacking Up Complete Record Disc Packages: (FIGS. 10, 11 and 12)

The sucking action of the suction members 25 and 26 is discontinued as soon as the cover plate 95 and the bottom plate 84 inserted into the empty jacket 22 together with the provisionally packed record disc 61 are withdrawn. As a result, the unsealed edge of the jacket 22 is closed with the provisionally packed record disc 61 accommodated in the jacket. Thus, there is obtained a complete record disc package 110. This package 110 is supported at four sides thereof by suction member 26 and the support members 132, 133 and 155, and is held at raised position.

As the transporting and inserting section 20 descends to the original inclined state indicated in FIG. 7, the arm 162 is rotated counterclockwise, and the suction member 26 moves in the arrow direction Y1 beyond the unsealed edge of the complete record disc package 110. In addition, the cylinders 135 and 153 are actuated to rotate each of support arms 132, 133, and 155 away from complete record disc package 110, thus releasing it and allowing it to drop into the stock section 28 into which succeeding packages are also dropped to form a stack.

When a prescribed number of the complete record disc packages 110 have accummulated in the stack, reinforcement plate suction mechanism 129 is operated to place a reinforcement plate 29 thereon. Specifically, when a detection device detects that a certain number of complete record disc packages 110 have been stacked on the pallet 121, a cylinder 180 is actuated to lower a suction member 181, which comes to make contact with the uppermost reinforcement plate 29 and draws it through suction action. Then, the cylinder 180 operates in reverse, and the suction member 181 moves upward together with the reinforcement plate 29 drawn thereinto.

The reinforcement plate 29 thus lifted is drawn through suction action, in turn, by a suction member 182, and the suction member 181 is rendered inoperative. The reinforcement plate 29 now drawn to the suction member 182 is transported in the arrow direction Y2, together with the carrying mechanism 131. When the reinforcement plate 29 held by the suction member 182 arrrives exactly above the stock section 28, the sucking action of the suction member 182 is discontinued whereby the reinforcement plate 29 drops onto the stack of complete record disc packages 110.

Figure 13:
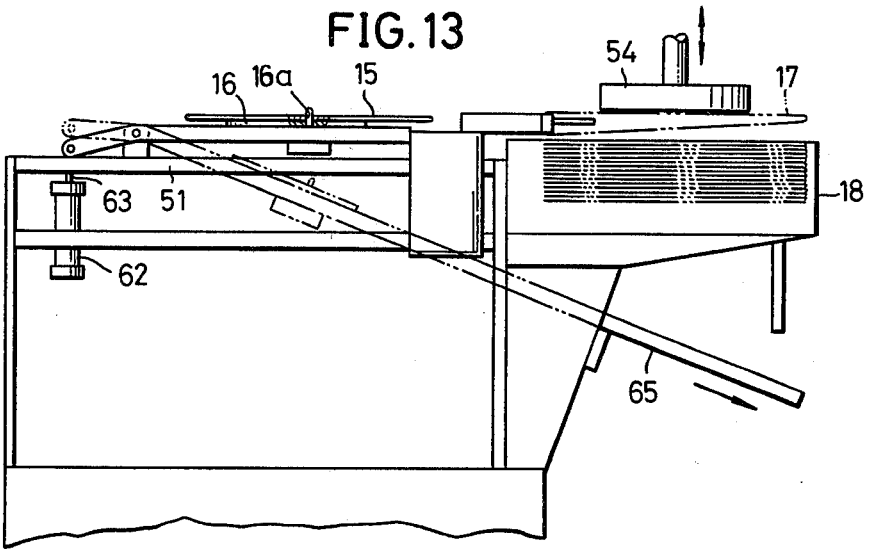
FIG. 13 is a front view of another embodiment of a mechanism for wrapping the bare record discs with the inner bags.
Figure 14:
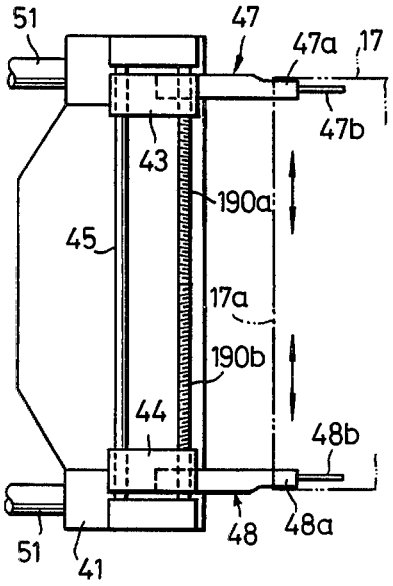
FIGS. 14 and 15 are a plan view and a side view, respectively showing an essential part of the mechanism illustrated in FIG. 13.
Figure 15:
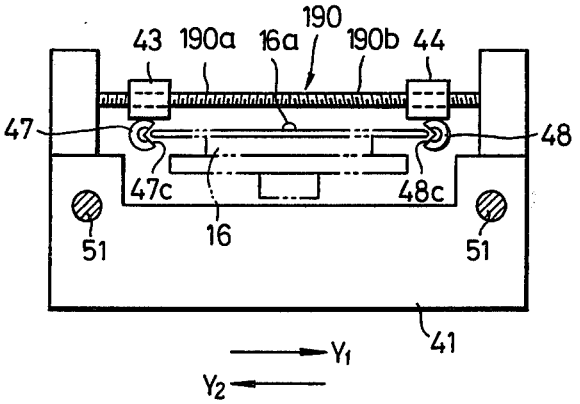

Next, another embodiment of a mechanism for covering the bare record disc with an inner bag will now be described with reference to FIGS. 13 through 15. Parts in FIGS. 13, 14 and 15 which are substantially the same as corresponding parts in FIG. 3 and FIG. 4 are designated by like reference numerals. Detailed description of such parts will not be repeated.

The carrying table 16 has a pin 16*a* projecting from the center thereof. The arm holders 43 and 44 are respectively in thread engagement with a left hand screw 190*a* and a right hand screw 190*b*. The screws 190*a* and 190*b* are formed on the left half and the right half parts of a single rod 190, as viewed in FIG. 15.

The operation for drawing the inner bag 17 over the record disc 15 is the same as in the embodiment described above, except for the operation described thereafter. Detailed description of idential operations will be omitted.

The bare record disc 15 is placed on the table 16 with the center hole thereof engaged by the projecting pin 16*a*. The movement of the arm members 43 and 44 in the directions indicated by arrows Y1 and Y2 is carried out by rotating the rod 190 in one direction or the other. Moreover, the arrangement is such that the pin 16*a* sinks into the table 16 when the free side 17*a* of the inner bag 17 being drawn over the record disc 15 reaches the center of the record disc 15.

Further, this invention is not limited to these embodiments but various variations and modifications may be made without departing from the scope of the invention.

What is claimed is:

1. An apparatus for automatically packing record discs comprising: an inner bag stock section stocking therein a number of inner bags in stacked arrangement; opening means for opening the unsealed edge of the uppermost inner bag in said inner back stock section; a record disc carrying table for receiving thereon a record disc to be packed, said record disc carrying table being stationarily disposed opposite the unsealed edge of the uppermost inner bag opened by said opening means; a holding mechanism comprising a pair of arm members movably disposed with the distal end thereof facing toward the unsealed edge of the uppermost inner bag opened by said opening means, means for moving the arm members to enter into the uppermost inner bag through the unsealed edge opened by said opening means, and means for moving the arm members apart from each other entered into the uppermost inner bag, whereby the uppermost inner bag is supported by the engagement between the arm members and the opposite ends of the unsealed edge thereof; a moving mechanism for moving the arm members with the supported inner bag toward said record disc carrying table in such a manner that the arm members pass by opposite sides of the record disc carrying table; and a stop member for restricting the record disc placed on said record disc carrying table from shifting in at least a direction in which said inner bag moves; whereby said moving mechanism draws said inner bag over the record disc on said record disc carrying table, said record disc being in effect inserted into the inner bag while remaining stationary on the stationary record disc carrying table.

2. An automatic record disc packing apparatus as claimed in claim 1, in which said stop member comprises a projection pin disposed to engage with a center hole of the record disc placed on said record disc carrying table, said projection pin being adapted to sink under said record disc carrying table interrelatedly with the inner bag covering operation.

3. An automatic record disc packing apparatus as claimed in claim 1, in which each of said pair of arm members comprises a cylindrical proximal arm part having a diameter and a cylindrical distal arm part having a diameter which is smaller than the diameter of said cylindrical proximal arm part, said moving means comprising means for moving the arm members until the cylindrical proximal arm parts thereof enter into the uppermost inner bag through the unsealed edge opened by said opening means, whereby the inner bag is supported by engagement between the cylindrical proximal arm parts of the arm members and the opposite ends of the unsealed edge thereof by said means for moving apart from each other the arm members, and said holding mechanism further comprising means operating to move the arm members to temporarily approach each other so as to release the engagement of the cylindrical proximal arm parts with the inner bag when the inner bag is partially drawn over the record disc by said moving mechanism and to subsequently travel away from each other so as to made the engagement of the cylindrical distal arm parts with the inner bag.

4. An automatic record disc packing apparatus as claimed in claim 1 which further comprises a mechanism for causing said record disc carrying table to incline after said record disc is accommodated within said inner bag to form a provisionally packed record disc, a mechanism for clamping said provisionally packed record disc onto which said provisionally packed record disc slidably descends from the inclined record disc carrying table and to insert said provisionally packed record disc thus clamped into an empty jacket, and a mechanism for holding said empty jacket at a position opposing said clamping and inserting mechanism, with the unsealed side thereof held open.

5. An automatic record disc packing apparatus as claimed in claim 4 which further comprises a mechanism for turning said provisionally packed record disc received from said record disc carrying table by 90 degree, said mechanism being disposed at a position preceding said clamping and inserting mechanism.

6. An automatic record disc packing apparatus as claimed in claim 4 which further comprises a mechanism for stocking in stacked arrangement complete record disc packages having said provisionally packed record discs inserted and accommodated within said jackets, and a mechanism for interposing and laying a reinforcement plate every time a prescribed number of said complete record disc packages are added to the stock.

* * * * *